United States Patent [19]

Hanks

[11] 3,957,297

[45] May 18, 1976

[54] TENNIS BALL RETRIEVER

[76] Inventor: William J. Hanks, Box 92594, Morris Brown Station, Atlanta, Ga. 30314

[22] Filed: July 18, 1974

[21] Appl. No.: 489,575

[52] U.S. Cl. ..... 294/19 A

[51] Int. Cl.[2] ..... A63B 47/02

[58] Field of Search ..... 294/19 R, 19 A, 99 R; 56/328 R; 248/165, 434, 170

[56] References Cited

UNITED STATES PATENTS

| | | | |
|---|---|---|---|
| 2,203,170 | 6/1940 | MacDonald | 294/19 A |
| 2,706,657 | 4/1955 | Talley | 294/19 A |
| 2,847,176 | 8/1958 | Phillips | 248/170 |
| 3,046,044 | 7/1962 | Christle | 294/19 A |
| 3,149,872 | 9/1964 | Ward | 294/19 A |
| 3,186,593 | 6/1965 | Miotke | 294/19 A X |
| 3,316,008 | 4/1967 | Baugh | 294/19 A |

FOREIGN PATENTS OR APPLICATIONS

| | | | |
|---|---|---|---|
| 152,771 | 11/1903 | Germany | 294/19 A |

*Primary Examiner*—John J. Love
*Assistant Examiner*—Johnny D. Cherry
*Attorney, Agent, or Firm*—Newton, Hopkins & Ormsby

[57] ABSTRACT

A tennis ball retriever is disclosed comprising a tube having an inlet through which a ball may pass, and a set of arcuate arms pivotally mounted to the tube adjacent the inlet for movement between positions of greater and lesser proximity to the interior walls of the tube. The arms are spring biased towards their position of lesser proximity where stop means are located.

6 Claims, 2 Drawing Figures

TENNIS BALL RETRIEVER

BACKGROUND OF THE INVENTION

This invention relates generally to ball retrievers, and particularly to retrievers of the type adapted to retrieve and store tennis balls from the surfaces of tennis courts.

Retrievers have heretofore been devised for lifting and storing golf balls from supporting terrain. These devices which are exemplified by those disclosed in U.S. Pat. Nos. 2,203,170, 3,316,008 and 3,558,170, have generally taken the form of a tube adapted to be placed over the golf ball and a set of resilient arms mounted within the tube adjacent the tube inlet for radial movement as a golf ball is forced therebetween up into the tube. Often a bag is tied to an outlet portion of the tube to receive retrieved balls for storage.

Though retrievers of the prior art have functioned well in retrieving and storing golf balls, they have met with only limited success when adapted through dimensional alterations, to retrieve and store tennis balls. A principle cause for such limited success with tennis balls has been attributed to the diverse structure of tennis and golf balls. Whereas golf balls are relatively rigid, tennis balls are quite flexible. Where the surface or skin of golf balls is smooth that of tennis balls is woolly or fuzzy.

In forcing the resilient arms of prior art golf ball retrievers radially apart tennis balls must be momentarily deformed from several sides, simultaneously which action places substantial stresses upon the ball that may adversely affect bounce characteristics. This problem may be alleviated to a degree through the use of springs of less strength. Small springs however are difficult to mount and regulate. Their use also increases failure rates necessitating frequent spring replacements. In addition, the forcing of tennis balls over the radially biased arms tends to rub off some of the wooliness or fuzziness of the balls at their points of arm contact and yet not at other portions of the ball skin. This action leaves the tennis balls with uneven fuzziness which further degrades their operative characteristics.

Accordingly, it is a general object of the present invention to provide an improved ball retriever.

More specifically, it is an object of the present invention to provide an improved tennis ball retriever and storage device.

Another object of the invention is to provide a tennis ball retriever which does not injure the resilience of the ball nor the texture of its skin.

Yet another object of the invention is to provide a tennis ball retriever with storage means that is easily removable from the retriever itself.

Still another object of the invention is to provide a tennis ball retriever of relatively simple and economic construction and one which possesses a high degree of ruggedness.

SUMMARY OF THE INVENTION

In one form of the invention a tennis ball retriever is provided comprising a tube having an inlet through which a ball may be passed into the tube, and at least one arcuate arm pivotally mounted to the tube adjacent the inlet for movement between positions of greater and lesser proximity to the interior walls of the tube. Means are provided for spring biasing the arm towards the position of lesser proximity. Stop means are also provided for stopping the arm at a position of lesser proximity.

In another form of the invention a tennis ball retriever is provided comprising a tube having an inlet through which a ball may pass into the tube, and a plurality of slots formed in the tube with one wall of each slot extending adjacent the inlet. A pair of tabs extend outwardly the tube from opposite sides of each of the slots. A plurality of arcuate arms are pivotally mounted to the tabs with each arm passing through two of the slots and a portion of the tube adjacent the inlet. A spring is mounted to each of the tabs biasing the arm mounted thereto towards the one slot wall.

DETAILED DESCRIPTION OF THE DRAWING

Figure 1:
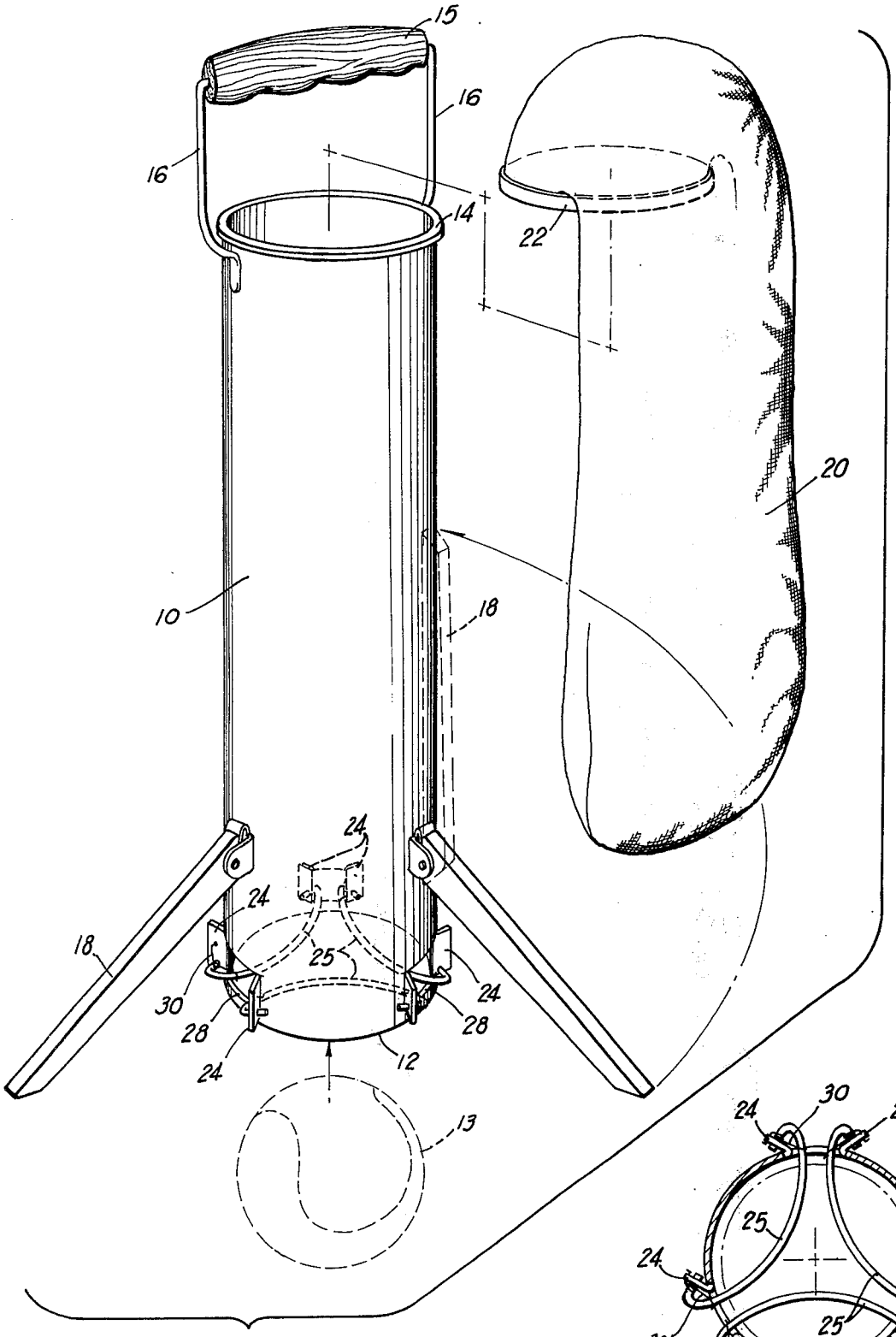
FIG. 1 is a perspective view of a tennis ball retriever and storage device embodying principles of the invention in one preferred form with a storage element shown detached from the retrieving element.

Referring now in more detail to the drawing, there is shown a tennis ball retriever and storage device embodying principles of the invention in one preferred form and comprising a cylindrical tube 10 preferably formed of a light weight material such as aluminum. The tube has a lower inlet 12 dimensioned to receive a tennis ball 13 therethrough, and an upper outlet 14 through which a tennis ball may exit the tube. A handle 15 is mounted above inlet 14 by means of a pair of parallel arms 16 rigidly secured to tube 10 adjacent outlet 14. If desired, arms 16 may be pivotally mounted instead of rigidly mounted to the tube. Three support legs 18 are pivotally mounted to a lower portion of tube 10 in tripod fashion. These support legs are adapted to be pivoted from their support position illustrated in solid lines in FIG. 1 to a retracted position in abutment with the tube as shown in dashed lines.

A storage bag 20 is provided composed of a flexible material such as cloth coated with a plasticizer or other preservative for enhanced longevity. A flexible mounting collar 22 is secured to an open end of the bag. The mounting collar is detailed in dimension to fit snugly over the lip of outlet 14 with the bag passing between the outlet and handle 15. When attached a major portion of the bag is draped to one side of the tube to provide a relatively compact overall configuration.

Figure 2:
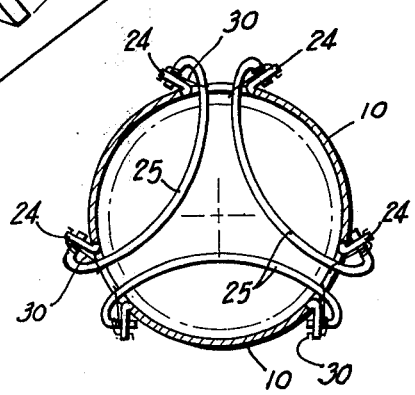
FIG. 2 is a bottom view of a retriever shown in FIG. 1 with selected components thereof removed for visual clarity.

With reference now to both FIGS. 1 and 2 tube 10 is seen to have three slots therein adjacent inlet 12. These slots are formed by making three H-shape incisions through the walls of the tube thereby forming two tabs 24 at each incision which are then swung outwardly of the tube. Each tab is provided with two small apertures, one above the other. Three arcuate wire arms 25 are then mounted to the tabs. As may best be seen by reference to FIG. 2 each arm extends through two adjacent slots and through a portion of the interior of the tube. Each end of each arm is journalled through one of the apertures in its supporting tab 24. Each arm is biased into engagement with the surface of a slot defining wall 28 which parallels the portion of inlet 12. This bias is provided by a thin wire spring 30 having a central portion wrapped around an end portion of arm 24. One end of each spring is mounted against an opposite side of arm 25 from wall 28, and the other end journalled within the other hole in the supporting tab.

For operation, handle 15 may be manually gripped to position tube 10 above a tennis ball 13 lying upon the surface of the tennis court. Tube 10 is then lowered with support arms 18 at their raised position bringing tennis ball 13 into contact with the arcuate arms 25. Downward pressure is then applied upon the retriever and against the tennis ball which causes arms 25 to pivot upwardly against the bias provided by springs 30 to a position in close proximity with the interior walls of the tube. As arms 25 pivot ball 13 enters the bounds of tube 10 passing through the arms. After the ball has passed the arcuate arms, springs 30 urge the arms back into the contact with walls 28 in a position of lesser proximity with the tube walls. In this position the arms provide a barrier preventing the retrieved ball from passing back out through inlet 12.

In passing the tennis balls through the arms it should be noted that the arms then themselves undergo minimal deformation since they merely rotate. This action tends to apply minimal forces to the tennis ball whereby the balls are not deformed even momentarily to any significant degree. Furthermore, it should be noted that the pivotal movement of arms 25 cause them to move with the ball and thus with minimal resistance with the ball skin, which action tends to minimize changes in the texture of the skin. For storing each ball the tube is rotated by handle 15 to an inverted position causing the balls to tumble out between handle 15 and outlet 14 into bag 20. To remove one or more balls stored within the bag flexible ring 22 is compressed at diametrically opposing sides thereby enabling the ring to be disengaged from the outlet lip.

It should be understood that the just described embodiment merely illustrates principles of the invention in one preferred fom. Many modifications may, of course, be made to the specifically illustrated embodiment without departure from the spirit and cope of the invention as set forth in the following claims.

I claim:

1. A ball retriever comprising a tube having a pair of spaced slots, an inlet through which a ball may pass into the tube, and a pair of tabs formed unitarily with said tube and projecting outwardly therefrom adjacent said slots; at least one arcuate arm pivotally mounted to said pair of tube tabs adjacent said inlet for movement between positions of greater and lesser proximity to the interior walls of said tube and with said arm being spring biased towards said position of lesser proximity; and stop means for stopping said arm at said position of lesser proximity.

2. A ball retriever in accordance with claim 1 wherein a slot defining surface of said tube provides said stop means.

3. A ball retriever comprising a tube having an inlet through which a ball may pass into the tube and a plurality of circumferentially spaced slots formed in the tube adjacent said inlet; a wall portion defining each slot; a pair of tabs integrally connected to an extending outwardly of said tube on opposite sides of the wall portion defining each of said slots; a plurality of arcuate arms pivotally carried by said tabs with each arm passing through two of said slots and into the interior portion of said tube adjacent said inlet; and a spring mounted to each of said tabs biasing the arm mounted thereto towards a portion of said wall portion.

4. A ball retriever in accordance with claim 3 further comprising a set of legs pivotally mounted to the outer surface of said tube for supporting the tube in a generally vertical orientation upon supporting terrain.

5. A ball retriever in accordance with claim 3 wherein said tube has an outlet through which a ball may pass out of the tube; a U shaped handle mounted to the outer surface of said tube and overlaying said outlet; and a flexible storage bag secured to and closing said tube adjacent said outlet and extending between said handle and outlet.

6. A ball retriever comprising a tube having an inlet through which a ball may pass into the tube and a plurality of slots formed in the tube with one wall of each slot extending adjacent said inlet; a pair of tabs extending outwardly said tube from opposite sides of each of said slots; a plurality of arcuate arms pivotally mounted to said tabs with each arm passing through two of said slots and a portion of said tube adjacent said inlet; and a spring mounted to each of said tabs biasing the arm mounted thereto towards said one slot wall each of said tabs defines a pair of apertures, and an end portion of one of said arms being journalled in one of said apertures and an end portion of one of said springs being journalled in another of said apertures.

* * * * *